United States Patent [19]

Bennison

[11] Patent Number: 4,644,885

[45] Date of Patent: Feb. 24, 1987

[54] METHOD OF AND APPARATUS FOR SET-BACK TIPPING OF NECKTIES

[75] Inventor: Michael N. Bennison, Leeds, England

[73] Assignee: Automated Machinery Systems, Inc., Richmond, Va.

[21] Appl. No.: 414,754

[22] Filed: Sep. 3, 1982

[30] Foreign Application Priority Data

Nov. 24, 1981 [GB] United Kingdom ..... 8135414
May 17, 1982 [GB] United Kingdom ..... 8214345

[51] Int. Cl.[4] ..... D05B 1/00

[52] U.S. Cl. ..... 112/262.2; 112/262.3; 112/121.12

[58] Field of Search ..... 112/121.11, 121.12, 112/121.15, 262.2

[56] References Cited

U.S. PATENT DOCUMENTS 4,010,701 3/1977 Helfont ..... 112/121.12
4,029,032 6/1977 Medynski ..... 112/121.22

*Primary Examiner*—Ronald Feldbaum
*Attorney, Agent, or Firm*—Willian Brinks Olds Hofer Gilson & Lione

[57] ABSTRACT

In the tipping of neckties, that is to say the provision of a lining to the basic or face fabric at one or both ends, it is highly desirable that the seam by which the lining is attached to the face fabric should be set back from the edge of the tie on the reverse side thereof, but the technique as hitherto practiced has not given the desired neatness of the tie at the corners without the expenditure of considerable time and manual dexterity.

The problem is mitigated by guiding the needle of a sewing machine to stitch the face and lining fabrics together along sets of first and second lines meeting at a corner and forming the face fabric into upwardly projecting pleats at the corner. Special means are provided to ensure that each pleat, which provides fullness in the face fabric, is not stitched down to the lining, and to avoid the stretching of the fabric while initially forming the pleats.

14 Claims, 16 Drawing Figures

METHOD OF AND APPARATUS FOR SET-BACK TIPPING OF NECKTIES

The invention relates to a method of and apparatus for use in the set-back tipping of neckties.

The tipping of neckties is the provision of a lining to the basic or face fabric at one or preferably both ends, and it is highly desirable that the seam by which the lining is attached to the face fabric should be set back from the edge of the tie on the reverse side thereof. The excess of face fabric required to allow the seam to be set back from the edge of the tie is commonly provided by adding fullness to the face fabric before stitching but the technique as hitherto practised has not given the desired neatness of the tie at the corners without the expenditure of considerable time and manual dexterity.

According to one aspect of the present invention there is provided apparatus for use in set back tipping of neckties having a face fabric and a lining fabric sewn together along at least one set of first and second lines meeting at a corner said apparatus comprising means for guiding the needle of a sewing machine to stitch the face and lining fabrics together along the or each set of first and second lines and means for forming the face fabric into an upwardly projecting pleat at the or each corner.

Preferably the apparatus further comprises means to avoid the stitching of the pleats to the lining fabric when the needle is guided along the said first and second lines of the or each set consecutively and respectively towards and away from the intermediate corner.

The apparatus may comprise a jig for supporting the face and lining fabrics in superimposed relationship, and the guide means may comprise elongate slots for guiding the sewing machine along said lines. The or each pleat forming means may comprise an elongate fulling blade.

Preferably the apparatus provides for three sets of stitch lines and the formation of pleats at three corresponding corners.

Means may be provided for moving the jig relative to the sewing machine in the direction of said slots and for turning the jig relative to the sewing machine at the or each corner.

The means to avoid stitching of the pleats may comprise means mounted on the sewing machine to divert the pleats from the path of the needle. The pleat diverting means may comprise wiper means movable relative to the predetermined lines. The movement of the wiper means may comprise two phases, firstly relatively along the length of the first line of the or each set and secondly to and fro transversely of the or each pleat. Additionally the movement of the wiper means may carry stitching thread across the loop.

Means may be provided to detect the relative approach of the sewing machine to the corner, said detection means being operative to effect said movement of the pleat diverting means.

The apparatus may further comprise control means, capable of being activated by said detection means and operable sequentially to:

(a) stop the machine with the needle up
(b) move the wiper means to and fro
(c) lower the needle without advancing the jig
(d) turn the jig about the needle
(e) restart the machine Moreover, a problem has arisen in initially creating the fullness in the face fabric when this is to be provided by more than one pleat, and in order to avoid the problem the jig may comprise means for forming a plurality of fulling pleats in the face fabric, said means being adapted to form one of said pleats before the other or others.

When the jig comprises a first plate having a pleat-forming projection upstanding therefrom for each fulling pleat, and a second plate pivotally mounted to be lowered from a raised position to lie in face to face contact with a fabric laid upon the first mentioned plate, and said second plate comprises surfaces arranged on said lowering to act in conjunction with one or more of the projections to drape a fabric so laid to form said other pleat or pleats, the jig further comprises a member defining at least one further pleat-forming surface, said member being arranged to be lowered independently of the second plate whereby said at least one further surface may act in conjunction with another of said projections to form said one pleat.

The independently lowerable member may be mounted on the second plate for pivotal movement between upper and lower positions relative thereto, and urged towards the lower position.

According to a further aspect of the invention there is provided a method of set back tipping of neckties having a face fabric and a lining fabric sewn together along at least one set of first and second lines meeting at a corner and comprising the steps of supporting the said fabrics on a jig in face-to-face relationship, guiding the needle of a sewing machine to stitch the fabrics together along the or each set of first and second lines and forming the face fabric into an upwardly projecting pleat at the or each corner.

The method may comprise the sequential steps of:

(a) stopping the machine with the needle up
(b) displacing the or each pleat ahead of the needle,
(c) lowering the needle without advancing the jig,
(d) turning the jig about the needle and
(e) restarting the machine Further according to the invention, where a plurality of fulling pleats are formed in the face fabric, the method preferably comprises forming said one of the pleats before the other or others.

Embodiments of the invention will now be described by way of example and with reference to the accompanying drawings, of which:

Figure 7:
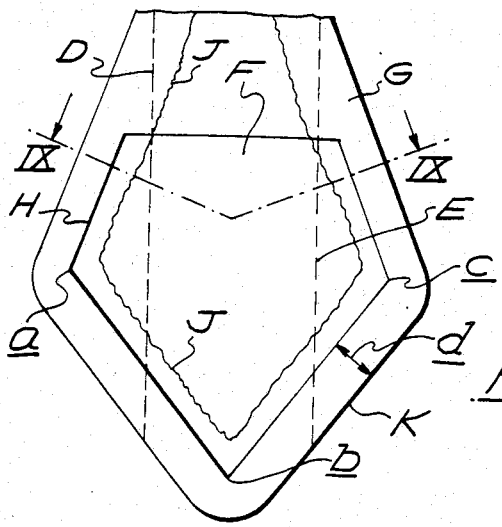
FIG. 7 is a rear view of a set-back tipped necktie.
Figure 8:
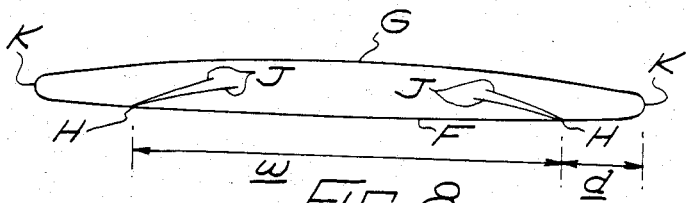
FIG. 8 is a section on line VII to VII of FIG. 7.

To illustrate the purpose of the invention FIG. 7 shows the end of a necktie having set back tipping. It can be seen that, when opened out flat from fold lines D,E, the tie reveals a panel F of lining fabric stitched to a shaped piece G of face fabric along seam line H set back from edge K of the tie and the assembled fabrics turned inside out so as to conceal the cut edges J of the component fabrics. It is also to be noted that the corners a, b, and c, in the stitch line are in mitred relationship with the corresponding corners of the edge K.

Figure 9:
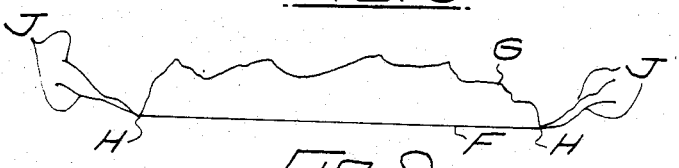
FIG. 9 is the section of FIG. 8 before inversion of the necktie.

The seam line H is set inward from the edge K of the tie by a substantially constant distance d, so that if the width of the lining fabric F between the seam lines H in the direction of line IX—IX in FIG. 7 is w, the corresponding width of the face fabric G needs to be w+4d. Accordingly, the face fabric G requires a certain amount of fullness between the seam lines H, H as shown in FIG. 9 before the stitched assembly is turned inside out.

Figure 1:
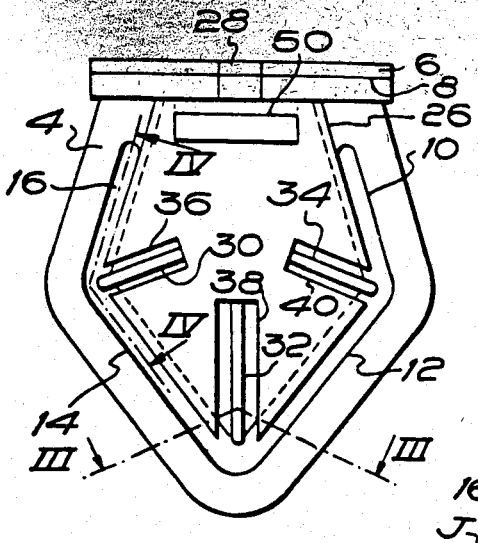
FIG. 1 is a plan view of a jig for use in necktie tipping.
Figure 2:
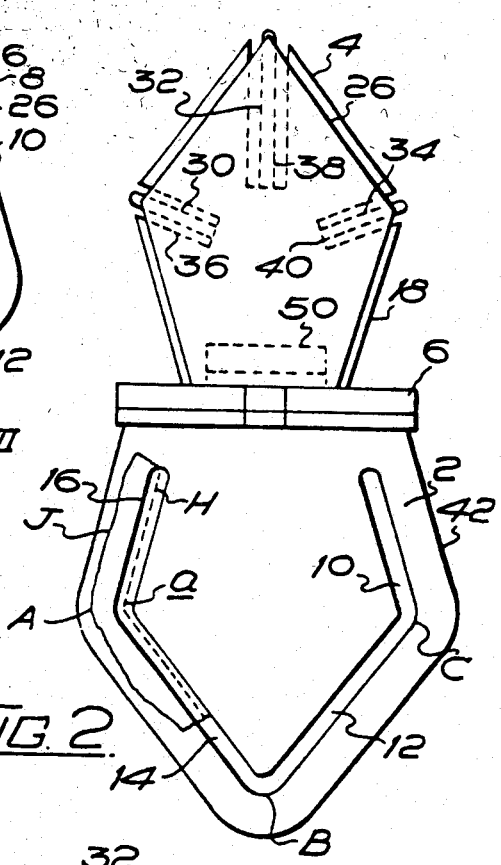
FIG. 2 is a plan view of the jig of FIG. 1 opened to show component plates.
Figure 3:
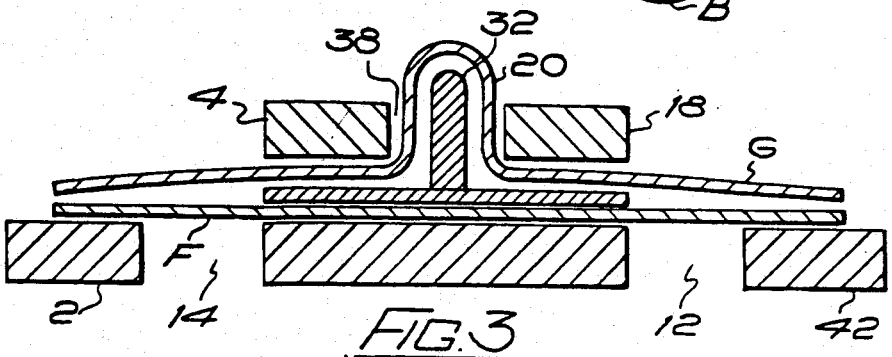
FIG. 3 is a section on line III to III of FIG. 1.

Apparatus for utilising the invention in a preferred embodiment comprises a sewing machine, a sequential controller, and a jig. The jig illustrated in FIGS. 1 and 2 comprises lower and upper plates 2, 4, hingedly mounted to one another by hinge 6 for turning about an axis 8 so that they can be angularly displaced from one another as shown in FIG. 2 and brought into face-to-face relationship as shown in FIG. 1. The lower plate 2 is provided with four slots 10, 12, 14, 16 interconnecting at corners A, B and C. The upper plate 4 is so shaped that when the plates are in superimposed relationship as shown in FIG. 2 its outer edge 18 is in alignment with the inner edge of the slots.

The slots in the lower plate 2 are of such width as to allow the relative movement therealong of a guide stud on a sewing machine, described in more detail in British published application No. 2062708A corresponding to U.S. Pat. No. 4,359,009 issued Nov. 16, 1982.

The slots define lines of stitching H for the seaming together of face and lining fabrics at the end of a necktie, by operation of the sewing machine needle 22, and the corners A, B and C correspond to the positions of the respective corners a, b and c of the stitch line.

A fulling plate 26 is hingedly mounted to the lower plate 2 by hinge 28 for movement about the axis 8 so as to be capable of being raised from lower plate 2 as shown in FIG. 2 when the upper plate 4 is raised, and lowered to lie flat upon the lower plate 2.

Figure 13:
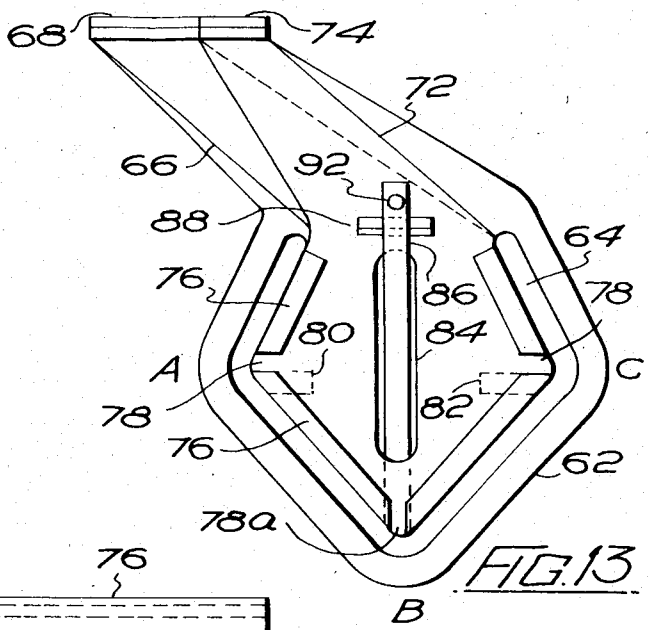
FIG. 13 shows an alternative embodiment of a necktie jig, closed, in plan view.

The fulling plate 26 mounts three fulling blades 30, 32 and 34 which, when the fulling plate rests on the lower plate 2 project upwardly and extend respectively towards the corners A, B and C. The blades are deeper than they are wide, and the upper plate 4 is provided with appropriately located slots 36, 38 and 40 through which the blades protrude in the lowered position of the plate 4. Plate 4 is also provided with an opening 50 through which the face fabric of the necktie can be passed, although the laterally offset location of the hinge shown in the embodiment of FIG. 13 eliminates the need for such an opening.

The outer edge 42 of lower plate 2 is generally parallel to the slots 10, 12, 14 and 16, and as described in applicant's issued U.S. Pat. No. 4,359,009 a drive wheel is provided in the sewing machine (not shown) for engagement with the edge 42 to advance the jig relative to the machine with the guide stud slidingly located in the slots.

As will be described below, the blades of the fulling plate in association with the slots in the upper plate 4 cause a piece of face fabric to be formed into upwardly projecting pleats 20 which extend respectively towards the corners A, B and C. The blades stop short of the corners but the pleats extend to the edge of the fabric as unsupported portions 46, crossing the slots in the lower plate and thus crossing the line of stitching H.

Figure 10:
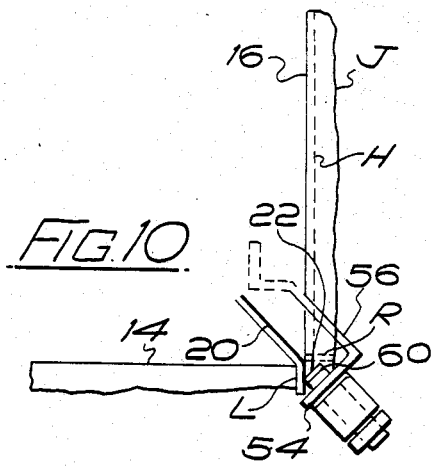
FIG. 10 is a detail plan view of a portion of a tipping apparatus showing a wiper blade.
Figure 11:
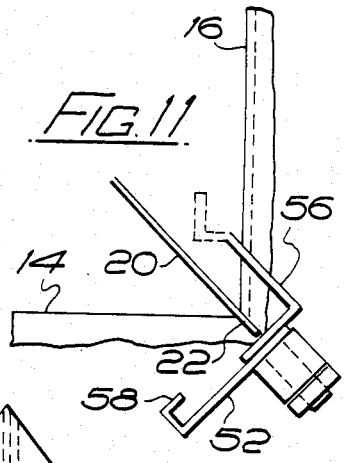
FIG. 11 is the view of the portion of FIG. 10 showing wiper blades in different orientation.
Figure 12:
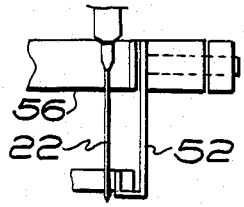
FIG. 12 shows the portion of FIG. 10 in elevation.
Figure 15:
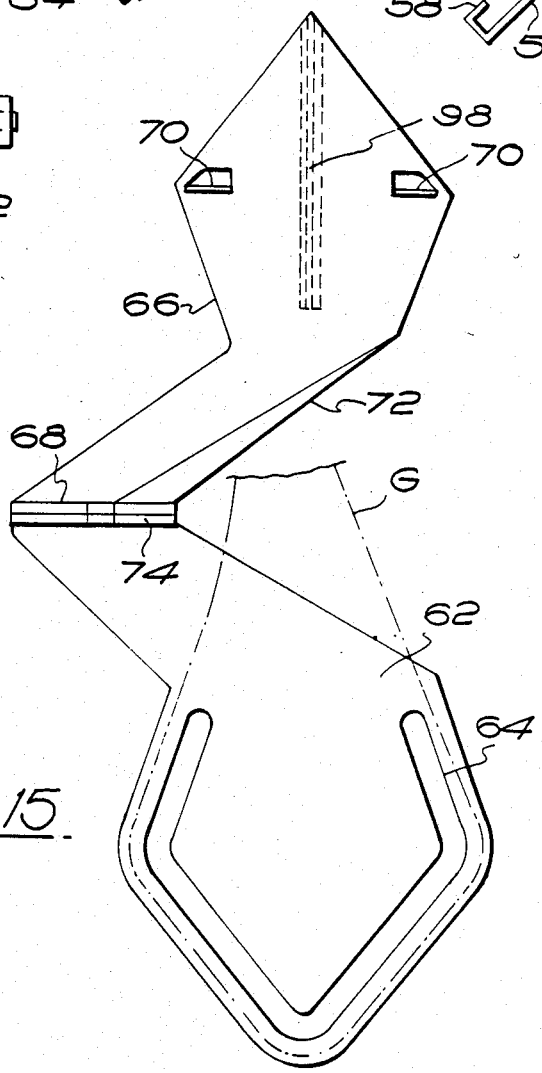
FIG. 15 shows the jig of FIG. 13 open and, in phantom lines the relative position of a necktie lining fabric.

In order to preserve the fullness in the face fabric, it is important to avoid stitching the pleat portion 46 to the lining fabric when the sewing machine reaches the corner. To this end, a wiper device shown in FIGS. 10, 11 and 12 is provided on the sewing machine. The wiper device is mounted to the presser foot pillar of the sewing machine by means of a bracket 56 and comprises a blade 52 pivotally mounted on a horizontal axis arranged above and forwardly of the needle 22 in the direction of movement of the sewing machine relative to the jig. The orientation of the pivotal axis relative to the direction of movement imparted by the sewing machine to the jig is such as to be substantially parallel to the lengthwise direction of each fulling blade as the jig approaches the corresponding corner.

Figure 5:
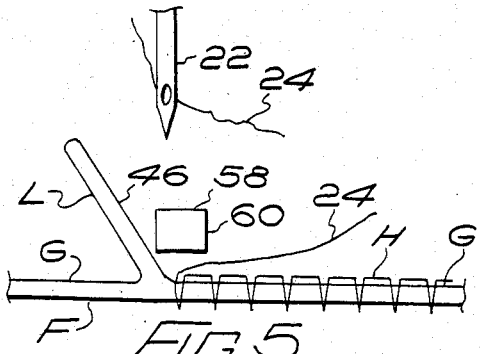
FIGS. 5 and 6 are diagrammatic representations of necktie fabric at successive stages of tipping.
Figure 6:
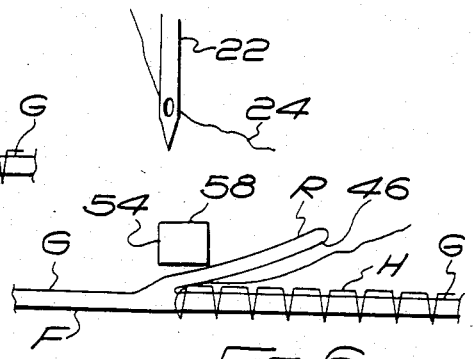

The blade 52 terminates in a return flange 58 which, when in the lowermost position shown in FIG. 10, engages with its edge 54 against the pleat ahead of the approach of the sewing machine needle to the corner so as to divert the portion 46 of pleat 20 out of the line of approach of the needle as shown in FIG. 5. The blade 52 is arranged to be swung to a position as shown in FIG. 11 whereby the flange 58 passes over the pleat. The blade is then returned to the original lowermost position whereby the pleat is diverted by the other edge 60 of the flange 58 to the opposite side of the original pleat position as shown in FIG. 6. Thus the pleat can be diverted between extreme positions at either side of its original position as dictated by the fulling blade, the angular displacement being related to the width of the flange 58.

In an alternative embodiment not shown, the pleat wiper is mounted on the base of the sewing machine for to and fro arcuate movement about a vertical axis.

The sequential controller referred to above is arranged to be activated by a feeler device which, as described in detail in applicant's issued U.S. Pat. No. 4,359,009 is mounted on the sewing machine in such a position as to detect when the jig is approaching such a position relative to the sewing machine that the needle occupies a position, designated a in FIG. 2, where the stitch lines towards and away from the corner are to meet. In this position of the needle, the pleat will have been diverted away from the approaching needle by edge 54 of flange 53.

The controller is arranged successively to activate mechanisms which execute the following actions, namely, (a) severing the thread carried by the needle, (b) stopping the forward movement of the jig relative to the machine, (c) raising the needle to its upper position, (d) tilting the blade 52 to the position shown in FIG. 11 and back, (e) lowering the needle into the fabric, (f) rotating the jig through the angle of the corner of the necktie, and (g) recommencing sewing with the needle following the slot away from the corner.

In use of the apparatus, the upper and fulling plates of the jig are first raised by hinging about axis 8 and a shaped portion of lining fabric is laid flat upon the lower plate 2 of the jig so that it extends over the slots therein and so that its cut edge J lies short of edge 42 as shown in FIG. 2.

The fulling plate 26 with its blades, 30, 32 and 34 is then lowered by its hinge 28 into face-to-face contact with the lining fabric. An end of the face fabric of the necktie, pre-cut to a shape similar to and with dimensions rather larger than the lining fabric is then laid right side downwards, loosely over the fulling plate, with the remainder of the tie passing through opening 50 in upper plate 4. The corners of the fabric are arranged in alignment with corners A, B and C of the jig.

The upper plate 4 is then lowered by hinge 6 into face-to-face contact with the face fabric the edges of the slots 36, 38 and 40 causing the face fabric G to be drawn over the blades 30, 32, 34 to form three distinct elongate pleats 44. Although the blades 36, 38 and 40 stop short of the corners A, B, C, the pleat lines 44 continue to the edge J of the fase fabric. The pleats take up the excess dimensions of the face fabric so that the cut edges are substantially aligned with the edges of the lining fabric, a point which will be referred to later in discussing a further refinement of the apparatus.

Figure 4:
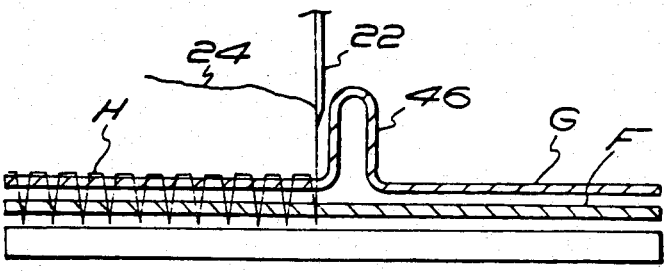
FIG. 4 is a section on line IV to IV of FIG. 1.

Tracing the assembly of lining and face fabrics along lines IV—IV as shown in FIGS. 1 and 4, the face fabric presents an unsupported loop 46 in the vicinity of corner A beyond the termination of the fulling blade 30, whilst there are similar unsupported loops at each of the corners B and C.

The jig so loaded is fitted to a sewing machine with the guide stud of the sewing machine in the slot 16 of lower plate 2 and the drive wheel in driving engagement with the adjacent edge 42 thereof whereby the machine advances relatively to the jig in the direction of stitch line H. The needle of the sewing machine provided with thread is set into reciprocating motion and commences stitching the face and lining fabrics together along stitch line H until it approaches corner A.

The flange 58 of the wiper blade 52 being located ahead of the needle in the direction of movement of the machine relative to the jig, edge 54 diverts the pleat to the position L (FIG. 10) out of line of approach of the needle 22 so that it is not caught thereby when the needle reaches the position a as is shown diagrammatically in FIG. 5. The controller then sequentially severs the needle thread 24, stops the relative movement of sewing machine and jig with the needle as close a possible to the point a and then stops the reciprocation of the needle with the needle in its up position. With the needle thus clear of the upwardly projecting pleat, the controller causes the blade 52 to perform a rocking motion about its pivot firstly in a direction away from the needle so that it rides over the pleat and then returning to its original position. After the blade has passed over the pleat, the resiliency of the fabric causes it to return to a position where it is contacted by edge 60 of the blade on its return movement so that it is diverted to the other side of the needle into position R as shown in FIG. 10 and diagrammatically in FIG. 6.

The needle is subsequently lowered without any relative movement between sewing machine and jig so that the needle re-enters the lining fabric F by or very close to the hole which it had previously occupied. The jig is then turned, either manually or by the action of the drive wheel with the edge 42 of plate 2, which is rounded at the corners, or by means of the mechanism described in applicant's issued U.S. Pat. No. 4,359,009. During this angular movement the needle acts as a pivot for the jig. When the rotation of the jig is completed, the reciprocation of the needle is re-commenced and the sewing machine advance relative to the jig is continued away from the corner, leaving there an open loop of face fabric.

After turning, stitching then continues along the stitch line H lengthwise of the next slot 14 until on the approach of the needle to the corner B a similar sequence of events takes place as that described above which results in a loop of face fabric G remaining also at corner B. A similar sequence of events takes place as the stitch line H is continued along the slot 12 whereby the jig is turned and an upstanding open loop of face fabric is left at corner C before the stitch line is continued along slot 10 and the stitching is terminated.

The stitching thread is then severed and the jig is removed from the sewing machine. The upper plate 4 and the fulling plate 26 are partially raised and the assembled end of the necktie is eased away from the fulling plate and its blades whereupon the necktie appears in section as shown schematically in FIG. 9. The open loops where the pleats met the stitch line H are then sewn up. The assembly is then turned inside out so that the cut edges J are concealed and the necktie is pressed flat with the seam lines H equidistant from edges K. A similar process is, if required, carried out at the other end of the necktie.

It will have been understood that the excess of face fabric located between opposed seam stitch lines, which is required to allow the seam to be set back from the edge of the tie, is drawn into that zone by the draping of the fabric over the fulling blades. As mentioned above, the face fabric is cut to a larger shape than the lining panel, and the draping of material over the blades draws the cut edges of the former in until they are substantially in alignment with the edges of the latter. This operation presupposes that the face fabric is indeed free to move in its own plane, but in practice this freedom may be curtailed in some circumstances.

For example, when there are three fulling means spaced across the face fabric and an attempt is made to operate each simultaneously, it is found that whilst the outer means are able to pull the fabric in from the free edges, frictional forces at least partially prevent the intermediate means from drawing fabric from the edges as this would involve pulling the fabric through the outer fulling means. The outer fulling means however exert a clamping effect and consequently the action of the intermediate fulling means is to stretch the face fabric. This stretching does not contribute to permanent fullness and in fact is positively disadvantageous.

The jig shown in FIGS. 13–16 has been designed to overcome this problem. It comprises a lower plate 62 shaped with corners A, B and C and having an elongate slot 64 therein. A fulling plate 66 is mounted on the lower plate by means of a laterally offset hinge 68, so that it can be laid in face to face contact with the lower plate 62 or raised therefrom. The shape of the fulling plate is such that, when it lies in face to face contact with the lower plate 62, its outer edge corresponds generally to the inner edge of the slot 64 in the lower plate 62.

Figure 14:
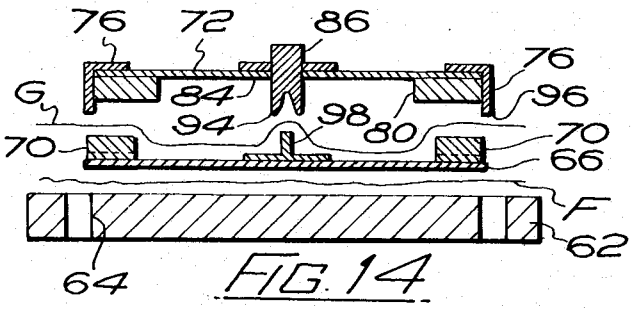
FIG. 14 is a section of line II—II of FIG. 13 with vertical spacing of parts exaggerated.
Figure 16:
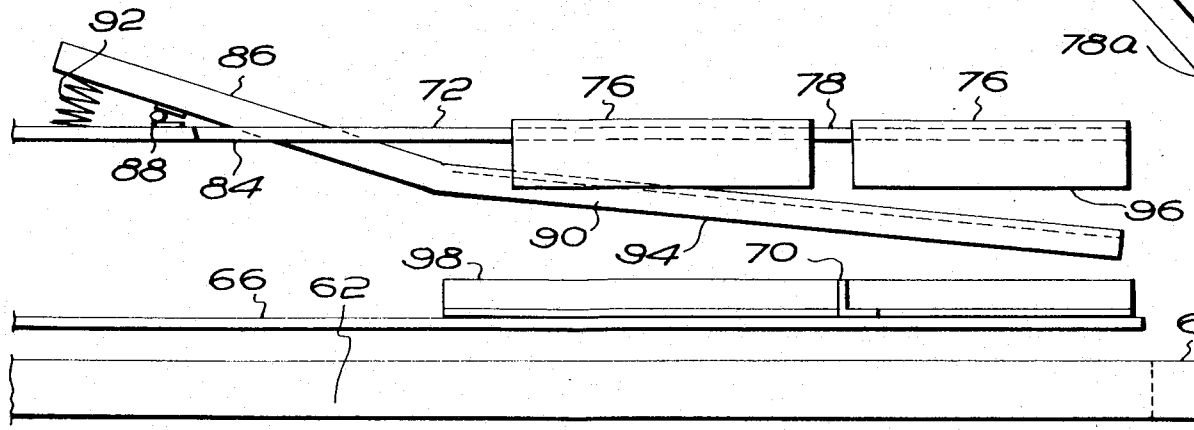
FIG. 16 is a partial side elevation of the jig of FIG. 13 with vertical spacing of parts exaggerated.

As shown more particularly in FIG. 14, the fulling plate 66 which is of sheet aluminium, supports on its upper face an elongate central upstanding rib 98 terminating, when plate 66 is in face to face contact with plate 62, at the inner edge of slot 64 at corner B. A pair of shorter upstanding ribs 70 are laterally oriented respectively towards corners A and C of the jig, and terminate at the edge of slot 64.

The jig further comprises an upper plate 72 mounted by hinge 74 to lower plate 62 for movement between an upright position and a lowered position where it overlies the fulling plate 66 to the peripheral shape of which it generally corresponds. Four flange strips 76 are arranged over the lateral edges of the plate 72 so as to project downwardly therefrom by approximately the same distance as the ribs 70 on the fulling plate 66 extend upwardly.

At each of the corners A, B and C, that is to say in the vicinity of the termination of the ribs 98, 70, gaps 78, 78*a* are left between adjacent flange strips 76. Blocks 80 of pliable material such as sponge rubber are secured to the underside of the upper plate 72 in such positions that when the upper plate is lowered into face to face relationship with the fulling plate 66, vertical edge 82 of each block lies parallel and close to the corresponding one of the laterally oriented ribs 70.

Along the median axis of the upper plate 72 there is an elongate slot 84 through which passes an elongate member 86 which is mounted on the upper plate 72 by means of a hinge 88.

The portion 90 of the member 86 overlying the rib 98 in the lowered position of the upper plate 72 is a channel of inverted U-section of such dimensions as to receive the rib 98 therein. By means of a spring 92, the member 86 is urged into a position in which the portion 90 lies generally below the plate 72 but can be raised relative to the plate 72 against the pressure of the spring 92 so as to lie with its lower edge 94 approximately on a level with the lower edge 96 of the flange strip 76.

In use of the apparatus, and with the plates 66 and 72 raised, a shaped piece of necktie lining fabric F (shown only in FIG. 14) is laid upon the lower plate 62, overlying the slot 64. The fulling plate is then lowered onto the lining fabric whereby the latter is held firmly against the lower plate 62.

An elongate shaped piece of necktie face fabric G is laid loosely over fulling plate 66 with its longitudinal axis along the rib 98, the offset position of the hinges 68, 74 allowing for the remainder of the face fabric, and of the lining fabric if required, to project beyong the line of the hinges. Similar hinges may with advantage be incorporated in the apparatus of FIG. 1. The face fabric portion G is of generally similar shape to but rather larger than the lining fabric so that it overlies slots 64 even allowing for draping over the ribs 98, 70.

The upper plate 72 is then lowered towards the face fabric G, the channel portion 90 of the member 86 first making contact with the face fabric under the influence of the spring 92 whereby the face fabric G is entrained about the rib 98 as it enters the channel. The pleat so formed in the face fabric extends beyond the forward end of rib 98 and the channel 90, passes through the forward gap 78*a* so that the pleat continues over that portion of the face fabric overlying the slot 64 at corner B.

Because of the downward orientation of the channel 90 relative to the plate 72, the takeup of fabric by folding thereof over the rib 98 takes place before the approach of the flange strips 76 to the ribs 70 exerts the above-mentioned clamping effect on the face fabric and inhibits inward movement of the fabric in its plane.

The channel 90 having located over the rib 98, however, the upper plate 72 is further lowered with compression of spring 92 and the entry of the channel 90 into the space defined between the flange strips 76.

On this further lowering, the blocks 80 and the edges of the flanges 76 defining the gaps 78 co-operate with the upstanding ribs 70 to drape the face fabric G thereover whereby to form lateral pleats extending over the slot 64 respectively in the directions of the corners A and C.

With the upper plate 72 held in the lowered position, the jig is introduced into a sewing machine in a manner substantially as described in relation to the FIG. 1 embodiment, the presser foot of the sewing machine (not shown) engaging the upper edge of the flange strip 76 as the jig is guided by means of the slot 64 to form a seam between the fabrics G and F along a line defined by the slot.

When seaming is completed, the upper plate 72 is raised and the fulling plate 66 slid out from between the now joined fabrics. The assembly of fabrics is turned inside out whereupon the fullness provided by the ribs 98, 70 results in the seam line being offset from the edge as described in relation to the FIG. 1 embodiment.

What is claimed is:

1. A sewing jig for sewing set back tipped ends of neckties by means of a sewing machine guided along a seam line bending at an end corner of the necktie and at two side corners on opposite sides of the end corner, comprising:

a base plate, a fulling plate, and an upper plate, the upper and fulling plates being movable relative to one another and relative to the base plate between raised positions over the base plate and lowered positions in which they are lowered toward the base plate so that the three plates lie against one another, said base plate and fulling plate being adapted to receive a piece of necktie lining cloth therebetween, said upper plate and fulling plate each having a tip corner and opposite side corners corresponding to said corners of the necktie, a first elongated fulling rib projecting upwardly from the fulling plate toward the upper plate and extending on the fulling plate to the tip corner thereof, second and third elongated fulling ribs projecting upwardly from the fulling plate toward the upper plate and extending on the fulling plate to respective opposite side corners thereof, pleat forming means having a fulling rib engaging means adapted to cooperate with the first fulling rib in a manner to form a first pleat in the necktie face cloth that is positioned between the fulling and upper plates of the jig, the pleat forming means being constructed and arranged to form the first pleat in the necktie face cloth when the upper plate approaches the fulling plate and before the fulling and upper plates completely come together, first and second fulling rib receiving means extending to respective opposite corners of the upper plate and adapted to receive the second and third fulling ribs, respectively, in order to form second and third pleats in the necktie face cloth, said pleat forming means that cooperates with the first fulling rib being yieldingly mounted to permit movement together of the upper and fulling plates after the first pleat is formed and before the second and third pleats are fully formed.

2. Apparatus as claimed in claim 1 wherein said base plate, said fulling plate and said upper plate are connected with one another so that said fulling plate and said upper plate may be lowered toward said base plate, and said pleat forming means is mounted on said upper plate and is biased downwardly from said upper plate towards said fulling plate.

3. Apparatus as claimed in claim 1 wherein said pleat forming means comprises a channel-section blade capable of receiving said first fulling rib in the channel thereof.

4. Apparatus as claimed in claim 1 and further including, means for preventing the stitching of the formed pleats to a lining fabric that is between the base and fulling plates when the sewing needle of a sewing machine is guided along said seam line.

5. Apparatus as claimed in claim 4 wherein the means for preventing stitching the pleats to the lining fabric comprises, wiping means adapted to be mounted on the sewing machine and extending downwardly towards said sewing jig, said wiping means having means to divert the pleats from the path of the needle as the needle moves along said seam line.

6. Apparatus as claimed in claim 5 wherein of said wiping means includes means for moving the wiping means along a path that intersects a pleat on one side thereof, and then along a path that intersects a pleat on the opposite side thereof.

7. A sewing jig for sewing set back tipped ends of neckties by means of a sewing machine guided along a seam line bending at an end corner of the necktie and at two side corners on opposite sides of the end corner, comprising:

a base plate, a fulling plate, and an upper plate, the upper and fulling plates being movable relative to one another and relative to the base plate between raised positions over the base plate and lowered positions in which they are successively lowered onto the base plate so that the three plates lie against one another, said plates being adapted to receive cloth pieces between adjacent plates, said upper plate and fulling plate each having a tip corner and opposite side corners corresponding to said corners of the necktie, first, second, and third elongated fulling ribs projecting outwardly from the fulling plate toward the upper plate and extending transversely on the fulling plate toward the respective corners thereof, pleat forming means yieldingly mounted to one of the fulling or upper plates and having fulling blade engaging means adapted to cooperate with the fulling blade at the end corner of the fulling plate in a manner to form a pleat in a necktie face cloth that is positioned between the fulling and upper plates of the jig, the pleat forming means being constructed and arranged to form a pleat in the cloth when the upper plate approaches the fulling plate and before the fulling and upper plates completely come together, first and second fulling rib receiving means at the respective opposite corners of the upper plate and adapted to receive fulling ribs at the corners of the fulling plate, said pleat forming means that cooperates with the fulling rib at the tip corner of the fulling plate being yielding in its mounting to permit movement together of the upper and fulling plates after the pleat is formed at the end corner of the face cloth and before pleats are fully formed at the opposite corners of the face cloth.

8. A sewing jig for sewing set back tipped ends of neckties by means of a sewing machine guided along a seam line bending at an end corner of the necktie and at two side corners on opposite sides of the end corner, comprising;

a first plate, a second plate, and a third plate, the plates being movable relative to one another between positions spaced from one another to positions in which they are brought together so that the three plates lie against one another, said plates being adapted to receive cloth pieces between adjacent plates, said second plate and third plate each having a tip corner and opposite side corners corresponding to said corners of the necktie, first, second, and third elongated fulling ribs projecting outwardly from the second plate and extending transversely on the second plate toward the respective corners thereof, pleat forming means yieldingly mounted to one of the second or third plates and having fulling blade engaging means adapted to cooperate with the fulling blade at the end corner of the second plate in a manner to form a pleat in a necktie face cloth that is positioned between the second and third plates, the pleat forming means being constructed and arranged to form a pleat in the cloth when the third plate approaches the second plate and before the second and third plates completely come together, first and second fulling rib receiving means at the respective opposite corners of the third plate and adapted to receive fulling ribs at the corners of the second plate, said pleat forming means that cooperates with the fulling rib at the tip corner of the second plate being yielding in its mounting to permit movement together of the second and third plates after the pleat is formed at the end corner of the face cloth and before pleats are fully formed at the opposite corners of the face cloth.

9. The apparatus claimed in claim 8 and further including, means for preventing the stitching of the formed pleats to a lining fabric that is between the first and second plates when the sewing needle of a sewing machine is guided alone said seam line.

10. Apparatus according to claim 9 wherein the means for preventing stitching the pleats to the lining fabric comprises, wiping means adapted to be mounted on the sewing machine and extending downwardly toward said sewing jig, said wiping means having means to divert the pleats from the path of the needle as the needle moves along said seam line.

11. Apparatus according to claim 10 wherein the movement of said wiper means includes a first movement along a path that intersects a pleat on one side thereof, and a second movement along a path that intersects a pleat on the opposite side thereof after the needle has been moved beyond said pleat.

12. A sewing jig for sewing set back tipped ends of neckties by means of a sewing machine guided along a seam line bending at an end corner of the necktie and at two side corners on opposite sides of the end corner, comprising;

a first plate, a second plate, and a third plate, the plates being movable relative to one another between positions spaced from one another to positions in which they are brought together so that the three plates lie against one another, said plates being adapted to receive cloth pieces between adjacent plates, said second plate and their plate each having a tip corner and opposite side corners corresponding to said corners of the necktie, an elongated fulling rib projecting outwardly from the second plate and extending transversely on the second plate toward the tip end thereof, pleat forming means yieldingly mounted to one of the second or third plates and having fulling blade engaging means adapted to cooperate with the fulling blade at the tip end of the second plate in a manner to form a pleat in a necktie face cloth that is positioned between the second and third plates, the pleat forming means being constructed and arranged to form a pleat in the cloth when the third plate approaches the second plate and before the second and third plates completely come together, and means for preventing the stitching of the formed pleat to a lining fabric that is between the first and second plates when the sewing needle of a sewing machine is guided alone said seam line.

13. Apparatus according to claim 12 wherein the means for preventing stitching the pleat to the lining fabric comprises, wiping means adapted to be mounted on the sewing machine and extending downwardly toward said sewing jig, said wiping means having means to divert the pleat from the path of the needle as the needle moves along said seam line.

14. Apparatus according to claim 13 wherein the movement of said wiper means includes a first movement along a path that intersects said pleat on one side thereof, and a second movement along a path that intersects said pleat on the opposite side thereof after the needle has been moved beyond said pleat.

* * * * *